US007688682B2

(12) United States Patent
Clervoy

(10) Patent No.: US 7,688,682 B2
(45) Date of Patent: Mar. 30, 2010

(54) ELECTRONIC TIMEPIECE OF THE MULTI-FUNCTION WATCH TYPE FOR NAVIGATIONAL AID, NOTABLY FOR A SPACE MISSION

(75) Inventor: Jean-Francois Clervoy, Saint-Germain-en-Laye (FR)

(73) Assignee: Organisation Intergouvernementale Dite Agence Spatiale Europeenne, Paris (FR)

( * ) Notice: Subject to any disclaimer, the term of this patent is extended or adjusted under 35 U.S.C. 154(b) by 0 days.

(21) Appl. No.: 11/662,292

(22) PCT Filed: Aug. 18, 2005

(86) PCT No.: PCT/FR2005/050676

§ 371 (c)(1),
(2), (4) Date: Feb. 12, 2008

(87) PCT Pub. No.: WO2006/027517

PCT Pub. Date: Mar. 16, 2006

(65) Prior Publication Data

US 2008/0130418 A1 Jun. 5, 2008

(30) Foreign Application Priority Data

Sep. 8, 2004 (FR) ..... 04 51985

(51) Int. Cl.
*G04B 25/00* (2006.01)
*G04F 10/00* (2006.01)
*G04B 19/22* (2006.01)

(52) U.S. Cl. ..... 368/21; 368/29; 368/73; 368/107

(58) Field of Classification Search ..... 368/29, 368/21, 71, 107
See application file for complete search history.

(56) References Cited

U.S. PATENT DOCUMENTS 3,646,751 A 3/1972 Purland et al.

(Continued)

OTHER PUBLICATIONS

Mission Elapsed Time :: science.nasa.gov/Realtime/Rocket_Sci/clocks/time-met.html :: Aug. 20, 2003.*

(Continued)

*Primary Examiner*—Vit W Miska
*Assistant Examiner*—Sean Kayes
(74) *Attorney, Agent, or Firm*—Fulbright & Jaworski LLP

(57) ABSTRACT

The invention relates to an electronic watch, notably for a space mission. It enables the setting, at any point in time, of a first date, start of the mission ($t_0$) with relation to a local time scale ($T_1$) or the Universal Time (GMT), and the determination of a first corresponding time scale (MET). It enables the setting, at any point in time, of a second date, start ($t'_0$) of one of the mission's phases with relation to the first time scale (MET) or to the Universal Time (GMT), and the determination of a second corresponding time scale (PET). It comprises means of setting, recording, calculating and analogue and digital viewing. The digital viewing means displays a negative time value (−) when the start date is located in the future and a positive time value (+) when this date has elapsed. It comprises five audio alarms, a chronometer and a "Timer".

7 Claims, 3 Drawing Sheets

U.S. PATENT DOCUMENTS

| | | | | |
|---|---|---|---|---|
| 6,144,619 | A | 11/2000 | Reisman | |
| 6,188,311 | B1 | 2/2001 | Rothschild | |
| 7,187,303 | B2 * | 3/2007 | Boyns et al. | 340/945 |
| 2003/0081507 | A1 | 5/2003 | Kitazawa | |
| 2004/0047242 | A1 * | 3/2004 | Germiquet et al. | 368/11 |

OTHER PUBLICATIONS

WayBack Machine :: web.archive.org/web/*/http://science.nasa.gov/Realtime/Rocket_Sci/clocks/time-met.html :: Dec. 12, 2008.*

* cited by examiner

ELECTRONIC TIMEPIECE OF THE MULTI-FUNCTION WATCH TYPE FOR NAVIGATIONAL AID, NOTABLY FOR A SPACE MISSION

The invention relates to an electronic timepiece of the multifunction watch type for navigational aid, more specifically a watch with multiple display and alarm means.

To simplify the description of the present invention, the term "watch" will be used to refer to this timepiece hereafter.

In the present invention, the term "navigation" shall be construed in its ordinary meaning: air, land or sea travel, speleological missions, etc.

It has particular application, although non-exhaustive, in the field of space missions of long duration.

To fix ideas, the following shall focus on the case of the preferred application of the invention, which is a space mission of a duration expressed in days or even in months.

In the context of applications referred to above, and more particularly for the aforementioned space missions, a number of needs are evident.

Firstly, the time of departure must be dated precisely. It follows that the characteristic events of the mission necessitate reference to time which is either "internal", i.e. relative to the start of the mission, or "external", such as the "Universal time" (Greenwich Meridian Time, "GMT"), still referred to as "Zulu Time" in certain Anglo-Saxon publications.

A certain amount of time-related and/or time-stamping information must also be available, displayable and produce selective audio and/or visual alarms.

Several time scales are also required, in such a way as to accommodate for different situations, notably in terms of variable durations of mission and/or specific phases of these missions.

Naturally, further to the aforementioned "Universal Time", the watch must be able to display the time corresponding to the local time zone, one or several times for other time zones. It must be equipped with standard functions such as "chronometer" and date display (day, month, year), etc.

Also, multi-function watches claiming to be "universal" have been proposed in prior art, notably in the context of applications more specifically concerned by the invention, i.e. navigational aid.

As a non-exhaustive example, the American patent U.S. Pat. No. 6,144,619 (John P. Reisman) can be quoted, entitled "FLIGHT WATCH WITH MULTIPLE TIMERS AND ALARM INDICATING MEANS".

This patent, as implied by the title, concerns an electronic watch equipped with several functions assisting an aircraft pilot with his flight programme. It satisfies the requirements of such an application, in an automatic and ergonomic manner, thereby freeing the pilot from his repetitive tasks and allowing him to focus fully on critical flight events without the distraction of subsidiary tasks.

The watch subject of this patent can display the local time, the "GMT" time (or "Zulu Time"), and forty-two time zones. It is equipped with several time counters, with six different scales, with a chronometer function, counters/count-down counters for time elapsed. It comprises analogue and digital viewing components and different alarms (of audio, visual and tactile type). These different functions can be preset using easy-access control buttons.

This watch, or similar watches, could be considered to respond fully to needs evident in the context of applications concerned by the invention, due to the significant quantity of functions with which they are equipped and their flexible use.

However this is not so, notably, but not exhaustively, in the case of space missions. Indeed, needs specific to such an application have not yet been met.

It must be possible to define a zero time with a precise date for a forward count or for a count-down.

The watch must then be capable of calculating automatically the time elapsed since, or the time remaining until, a given event. The time elapsed (in days, hours, minutes, seconds) since an event of known date should not require the operator of the watch to be on the alert for the start point when he has to set the chronometer in motion.

Furthermore, the time remaining until an event of known date must not require mental calculation on the part of the operator to determine the period that he needs to set on his time counter, a period which separates the time when he will start the count-down from the time at which the programmed event will take place.

This is a very important point in the context of space missions, where all activities are planned either according to the time elapsed since the time of lift-off, abbreviated as "MET" (for "Mission Elapsed Time", or according to the Universal Time ("GMT"). To simplify the description of the present invention, said abbreviations "GMT" and "MET", will be used hereafter. "MET" is therefore comparable to an advanced "chronograph" function.

The start time is defined in the watch by the lift-off date and not by pressing a predetermined button of the watch at the precise time of lift-off. It should be possible to input or "enter" this date into the watch both before and after lift-off.

Some of these space operations must be dated with high precision with relation to the "MET" or with relation to the "GMT" and require in turn the implementation of a count-down until a determined period of time has elapsed since an event characteristic of such an operation.

An excursion into the space vacuum would be a perfect example of such an operation. Due to communication restrictions, the airlock door must be opened at a precise point in time, and due to autonomy restrictions; a maximum working time must be respected outside the spaceship. The astronaut must therefore be aware of the time remaining, permanently, in order to prepare for the effective opening of the door, as well as the time elapsed since the start of his excursion.

Other events generating the same requirement are ignition of a spaceship's orbit changing engine, docking with another spacecraft, the undocking of a satellite from the spacecraft's cargo bay, etc.

If the operator commits an error when starting the chronometer at the launch of a significant event yet he knows the date, he should be able to enter this date into his watch, which would compensate for the operator's lateness and display the exact elapsed time.

Lastly, it should be possible to determine the time elapsed since a determined event, which we will arbitrarily qualify hereafter as "positive time", or the time remaining until a determined event, which we will arbitrarily qualify hereafter as "negative time", the date of said determined event being adjustable by the operator.

In the preferred application of the invention, this time lapse corresponds to a phase in the space mission, which can comprise several phases. Also, this time lapse will be referred to hereafter as "PET" (for "Phase Elapsed Time").

It should be made possible for the operator to adjust the time scale to a suitable selected time scale, either with relation to "GMT", or with relation to "MET".

The invention aims to overcome the disadvantages of devices of the prior art, to respond to requirements which are evident in the fields of application concerned by the invention, some of which have been referred to above.

The objective set by the invention is a multi-function watch for navigational aid, notably for a space mission.

To achieve this objective, according to a first important characteristic, the watch according to the invention comprises first means enabling the definition of a start time for a first predetermined event, by inputting into the watch a start date for this event, and means for determining, recording and displaying the time elapsed starting from this event with relation to predetermined time scales.

In a preferred embodiment of the invention, this date can be entered at any point in time, i.e. more specifically indifferently before or after the occurrence of the event, function which was referred to above as "MET".

According to a second important characteristic, the watch conform to the invention comprises means for determining, recording and displaying a period of time remaining until a second predetermined event, i.e. the start of a phase in the mission ("PET"), time that will be referred to as "negative", or the time elapsed since this event, which will be referred to as "positive", said predetermined event allowing adjustment by the operator of the time scale selected with relation to a predefined start time, either with relation to "GMT", or with relation to aforementioned "MET".

Naturally, the watch according to the invention comprises means for entering, recording and displaying the "GMT" time.

In a preferred embodiment, it also comprises means for entering, recording and displaying several time zones.

In a further preferred embodiment, the watch according to the invention comprises several "count-down time counter" chronometers, advantageously five, in such a way as to dispose of several alarms. Advantageously, each alarm is associated to a distinct audio signal, for example an alarm or a predefined sequence of "beeps".

In a still further preferred embodiment, the watch according to the invention comprises a double display: a first display of analogue type and a second display of digital type.

The main subject of the invention is therefore an electronic timepiece of the watch type for navigational aid, notably for a space mission, said navigation being associated to a start time for a first predetermined event, comprising input and entry means for date and/or duration data, storage means for saving said entered data, calculation and clock signal generation means, at least digital display means for displaying said entered data and/or data generated using this data under the command of said calculation and clock signal generation means, characterised in that said data input and entry means and said storage means are arranged for the entry and storage of a first start date linked to the Time called Universal determined by the Greenwich meridian and the generation of a first time scale having as start date said first date, in that said data input and entry means and said storage means are arranged for the entry and the storage, at any point in time, of a second start date corresponding to said predetermined first event, called start of mission, and the generation of a second time scale, said second time scale being determined at least using said first time scale, and in that said digital viewing means display a time value called negative when said first start date is in the future and a time value called positive when this date has elapsed.

The invention will now be described in a more detailed manner and will refer to annexed drawings, amongst which:

The following shall focus, without restricting the scope of the present invention in any way, on the context of the preferred application of the invention, unless specified to the contrary, i.e. in the case of a space mission.

Figure 1:
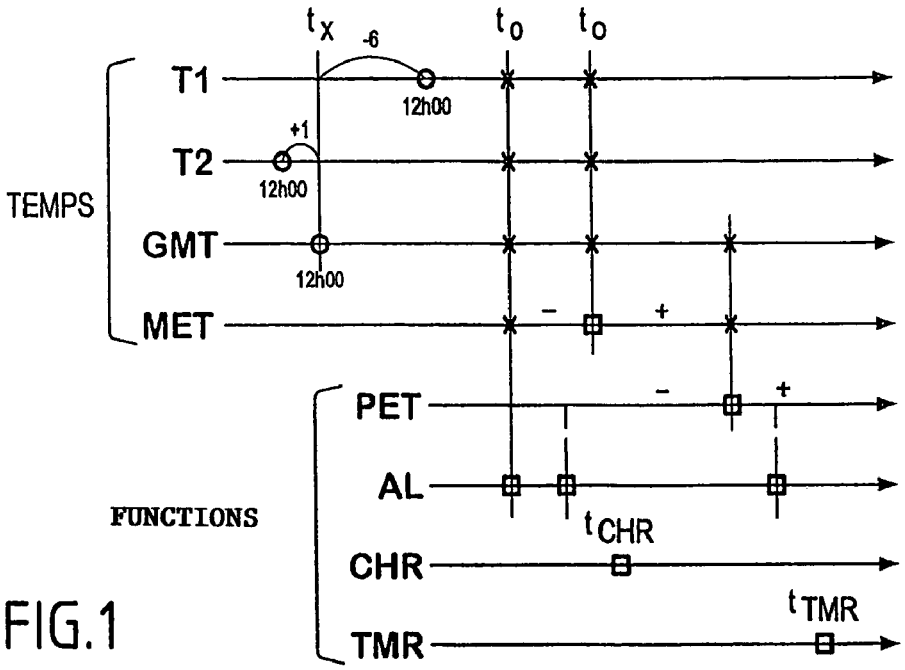
FIG. 1 is a time diagram illustrating schematically the operating procedure of a watch according to the invention and the interdependence of main time scales.

FIG. 1 is a time diagram illustrating schematically the operating procedure of a watch according to the invention.

On this diagram, and hereafter, the terms used correspond to the following definitions:

Time scale "$T_1$": Local time for a time zone referred to arbitrarily as "number 1".

Time scale "$T_2$": Local time for a time zone referred to arbitrarily as "number 2".

Time scale "GMT" (for "Greenwich Meridian Time", also referred to as Universal Time): the number of days are counted since the first of January. It is the universal reference time scale used on all navigation missions during which spaceships can be brought to change time zones regularly. "GMT" is a former acronym which is now often replaced by "UTC" (for "Coordinated Universal Time").

Time scale "MET" (for "Mission Elapsed Time"):

Time elapsed since a predetermined time, in this case the start of the space mission. It is defined in one of the time scales $T_1$, $T_2$ or "GMT". In the case of the aforementioned space flight, this concerns the precise time of the spaceship's lift-off.

"Alarm" ("AL") function: Emission of an audio signal on a date that can be set by the operator of the watch in a pre-selected time scale, either $T_1$, $T_2$, "GMT" or "MET".

"PET" ("Phase elapsed time") function: This is the time remaining until a predetermined event, referred to as "negative", or the time elapsed since this event, referred to as "positive", the date of this event being adjustable by the operator of the watch in a pre-selected time scale, either "GMT", or "MET". It should be reminded that during a space mission, "PET" is the time reference used for excursions into space, meeting or separation phases of spaceships, orbit corrections or re-entry into the atmosphere.

"Timer" ("TMR") function: This is a count-down starting from a predefined quantity of time, for relatively short periods of time. This function is a standard watch function.

"Chronograph" function ("CHR"): This is a forward count that measures, with precision, the time elapsed since the time at which the operator set in motion the device, for relatively short periods of time. This function is a standard watch function. Nevertheless, it should be noted here too that for standard requirements, the "hours-minutes-seconds" or "minutes-seconds-1/100 sec." resolutions are usually provided by chronographs, whereas these two ranges are not usually provided.

The three upper axes on the diagram in FIG. 1 show the time scales, whereas the four lower axes show the functions.

More precisely, the two upper axes on the time diagram in FIG. 1 show the time scales for time zones, "$T_1$" and "$T_2$", which have been referred to as N° 1 and 2, respectively.

An arbitrary time tx, or present time, in the space mission has been represented, respectively at (12 H−6) with relation to the local time $T_1$ and at (12 H+1) with relation to the local time "$T_2$".

The present time tx corresponds to 12 H on the Universal Time "GMT" axis (third time axis in FIG. 1, under axes "$T_1$" and "$T_2$".

The two lower axes in FIG. 1 correspond to "MET" and "PET" time scales, respectively.

A space mission can comprise one or more different phases. A number corresponding to different "PETs" can therefore be defined.

However, by definition, there is only one "MET" per mission, a time which defines the start of this mission, for example the precise time of the spaceship's lift-off as referred to above.

On the diagram in FIG. 1, $t_0$ has been called 0 time or start of the "MET" time scale, which can be defined with relation to one of the "$T_1$", "$T_2$", or "GMT" time scales.

On the diagram in FIG. 1, $t'_0$ has been called 0 time or start of the "PET" time scale, which can be defined with relation to one of the "MET" (time scale that is "internal" to the mission) or "GMT" (time scale that is "external" to the mission) time scales.

According to one important characteristic of the invention, "PET" should be considered as a "Timer" function (as defined below), but with the setting parameter being a date rather than a period of time.

According to another characteristic of the invention, the $t_0$ and $t'_0$ times (defined by dates) can be entered into the watch at any point in time, knowing the precise time of the start of the mission, to be stored and displayed therein.

According to another characteristic of the invention, "negative" and "positive" times are therefore defined, noted "+" and "−" respectively, on the axes of the "MET" and "PET" time scales.

On the "CHR" and "TMR" axes, the arbitrary times tCHR and tTMR which action these functions have also been represented.

The configuration of a watch 1 according to a preferred embodiment, more specifically the display units of this watch, will now be described, with reference to FIG. 2.

Hereafter, the display and setting formats and parameters for the watch 1 are defined conventionally as follows:

Display Format:

The display format can differ from the format used for the setting.

The following code is used to represent the display or the setting:

Y=year;

M=month: 1 to 12 (1 or 2 figures) or: JAN to DEC (three letters)

J=day of the week (to fix ideas, in English: MO, TU, WE, TH, FR, SA and SU);

D=date in the month: 1 to 31 (1 or 2 figures);

d=number of the day. 000 to 366 for GMT or −99 to 999 for "MET" or "PET";

h=hour: 0 to 23 (1 or 2 figures)

m=minute: 00 to 59 (2 figures)

s=second: 00 to 59 (2 figures)

s/100=hundredth of second: 00 to 99 (2 figures).

Display Parameters:

The display parameters are specified in the table:

"TABLE: Display parameters", annexed to the present description.

Setting Parameters:

"$T_1$" or "$T_2$": + or − h with relation to "GMT" (with h expressed in hours)

"GMT": X.Y.M.D.h.m.s;

relation wherein X is a letter that specifies the language selected for showing the days, which also applies to the months if the operator opts for them to be displayed in letters. X precedes the two figures YY specifying the year during the setting. X can take the values "F" (French), "E" (English) and "S" (Spanish) "MET": " - - - ", or setting for the time scale "$T_1$" or "$T_2$" or "GMT":

−/+ .M.D.h.m.s for setting in "$T_1$" or "$T_2$" time

−/+ d.h.m.s or M.D.h.m.s for setting in "GMT" time

"TMR": h.m.s

"CHR": 0.00.00/00

Alarm ("AL"): alarm number, "ON" (enabled) or "OFF" (disabled), with time scales M.J.D.h.m for alarm in the "$T_1$" and "$T_2$" time scale, d.h.m.s for alarm in the "GMT" and "MET" time scale "PET":" - - - ", or setting for the "MET" or "GMT" time scale −/+ d.h.m.s for setting in the "MET" time scale −/+ d.h.m.s or M.D.h.m.s for setting in "GMT" time.

"MET" or "PET" settings consist in defining the date of the zero time for "MET" or "PET", respectively, expressed in another time scale. When three dashes (" - - - ") are displayed in the position of the reference time, this means that "MET" or "PET" are undefined. Since the year is not a parameter that is available for setting "MET" or "PET", the signs "−" or "+" are used to specify whether the date entered is in the past or (by default) in the future.

Figure 2:
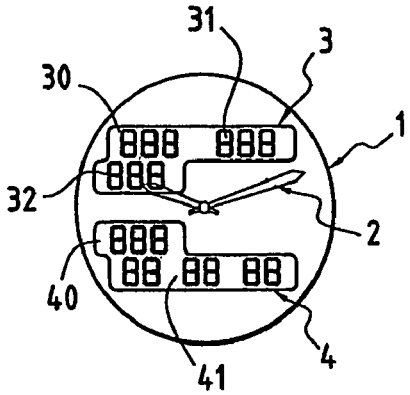
FIG. 2 illustrates schematically a top view of the external configuration of a watch according to a preferred embodiment of the invention.

In the example provided in FIG. 2, the watch 1 comprises advantageously two types of display units: an analogue display component with hands 2 and digital display components, 3 and 4, in a per se conventional manner, with liquid crystal display.

Preferentially, the analogue display by hands 2 is used essentially for the display of the local time in time zones "$T_1$" or "$T_2$".

Advantageously, the screen 3 is subdivided into three zones, referenced 30 to 32, and the screen 4 into two zones, 40 and 41. The functions of these zones will be specified below with reference to the description in FIGS. 3A to 7C, it being understood that zones 30 and 31 are used to specify the type of data or functions currently displayed: "$T_1$", "$T_2$", "GMT", "MET", "PET", etc.

In the following, since in the embodiment described the year is not an available parameter, during settings of "MET" or "PET", the signs "−" or "+", respectively, can be used to specify whether the date entered into the watch is in the past or (by default) in the future.

In these figures, so as not to encumber the drawing unnecessarily, the hands of the analogue display 2 have not been included. Furthermore, elements that are identical from one figure to another and identical to those in FIG. 2 bear the same references and will not be re-described unless so required.

Lastly, the detailed settings and displays of the watch 1 will be described hereafter with reference to tables "TABLE $T_1$" to "TABLE PET" annexed to the present description.

Figure 3A:
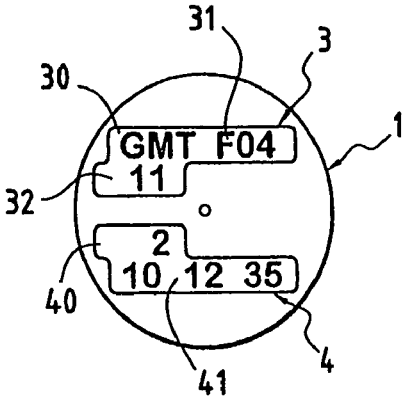
FIGS. 3A and 3B illustrate the setting and display of the function called "GMT" (Universal Time)

FIG. 3A illustrates an example of "GMT" setting for Tuesday 2nd Nov. 2004, 10 hours 12 minutes 35 seconds.

The letters for the "GMT" function are entered into zone 30 of the watch 1. "F04" ("F" for French), "11", "2", and "10 12 35" are entered into zones 31, 32, 40 and 41, respectively.

Figure 3B:
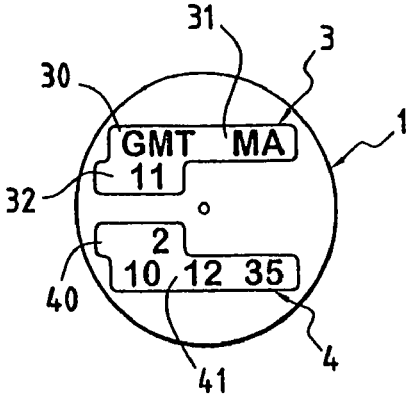

FIG. 3B illustrates an example of the display of the "GMT" function which has just been set (FIG. 3A).

During the display, the watch 1 calculates automatically the day of the week (TUESDAY in the example provided) corresponding to the date and the language (French) entered by the operator.

The "GMT" function is displayed in zone 30, "TU" is displayed in zone 31, "11" is displayed in zone 32, "2" is displayed in zone 40 and the time ("10 12 35") in zone 41.

As a first alternative, no information is displayed in zone 32 and the number "307" is displayed in zone 40, the other zones staying the same.

As a second alternative, zone 32 displays "NOV" instead of the number "11", the other zones staying the same.

Figure 4A:
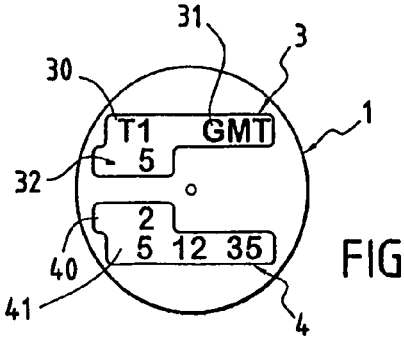
FIGS. 4A and 4B illustrate the setting and display of a time scale corresponding to a specific local time zone.

Assuming that the time zone N° 1 (scale "$T_1$" in FIG. 1) represents the local time in HOUSTON (USA), FIG. 4A illustrates a setting example of the "$T_1$" function, being a time zone differential of −5 hours with relation to the "GMT" (previous setting in FIG. 3A).

The letters of the "$T_1$" function are entered into zone 30 of the watch 1. "GMT", "−5", "2, "5 12 35" are entered into zones 31, 32, 40 and 41, respectively.

Figure 4B:
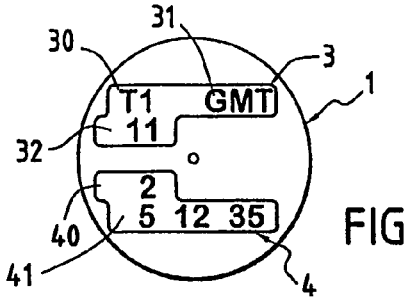

FIG. 4B illustrates an example of the display of the local time, set as follows: function "$T_1$" (zone 31), day ("TU": zone 31), month (number: zone 32), day of the year (zone 40) and "hours, minutes, seconds" (zone 41), so 5 H 12 mn 35 s.

Figure 5A:
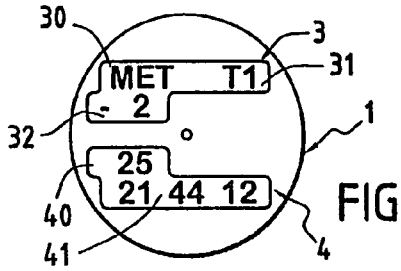
FIGS. 5A and 5B illustrate the setting and display of a date corresponding to the start time of a space mission, called "MET", with relation to the local and Universal time scales, respectively.

FIG. 5A illustrates a first example of the "MET" setting (zone 30), assuming that the zero time of "MET" (FIG. 1: t0) is defined by the following date: "25" (zone 40) February (number "−2": zone 32) at 21 H 44 mn 12 s ("21 44 12":

zone 41), HOUSTON time, this being the local time in the "$T_1$" time zone, as defined previously. This setting is therefore defined with relation to this time scale ("$T_1$": FIG. 1).

It could just have well have been defined with relation to a different local time scale, for example "$T_2$".

Figure 5B:
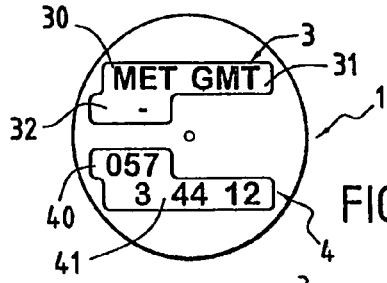

FIG. 5B illustrates a second example of "MET" setting, but with relation to the "GMT" time scale (FIG. 1), using this same data. Zone 30 still specifies that it refers to the "MET" setting, but zone 31 now specifies that it refers to "GMT" and no longer to "$T_1$". Zones 32, 40 and 41 are set as in the case in FIG. 5A. Zone 32 only displays the negative sign ("−").

Figure 5C:
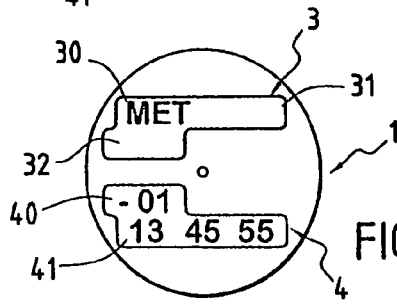
FIG. 5C illustrates the display of "MET", before the departure of the spaceship.

FIG. 5C illustrates an example of the display of the "MET" function, here one day and 13 H 45 nm 55 s (zone 41) before the departure of the spaceship, i.e. the beginning of the mission. According to an important characteristic of the invention, "MET" can be set at any point in time, before or after the zero time t0. The first case concerns a negative time: zone 40 therefore displays "−01" (for minus one day). Zones 31 and 32 do not display any data.

A "−" sign located under "MET" specifies that the date of the zero time of the "MET" used for the setting is in the future. This is the default value. A "+" sign means that the start time of the "MET" is in the past. This operating procedure avoids, as specified previously, having to include the current year when entering the date of the zero time.

As a first alternative for the setting, "−2" and "26" are entered into zones 30 and 40, respectively.

As a second alternative for the setting, if "GMT" is not defined, " - - - " is entered into zone 31, and zones 40 and 41 display "000" and 0 00 00", respectively.

The setting and the display of a "chronograph" function is carried out in a conventional manner and these operations do not need to be re-described in detail. Zone 30 indicates "CHR" and zones 31 and 41 indicate "00" and "0 00 00", respectively, before activation of the chronometer. Zones 32 and 40 do not display any data.

After activation, zone 41 displays the time in hours, minutes, and seconds, for example the number "0 02 31" (0 hours 02 minutes 31 seconds) and zone 31 displays the hundredths of seconds, for example the number "89". It can be noted that hours, minutes and seconds are positioned in their respective usual location in order to prevent any confusion with the hundredths of seconds.

The setting and the display of a "Timer" or "TMR" function is also carried out in a per se conventional manner. Zone 31 indicates "TMR", zone 41 indicates the length of the count-down time, for example "2 45 32" (for 2 hours 45 minutes 32 seconds) and zone 40 indicates the "−" sign to specify that it refers to a count-down. Once activated, "TMR" decrements in seconds.

Figure 6A:
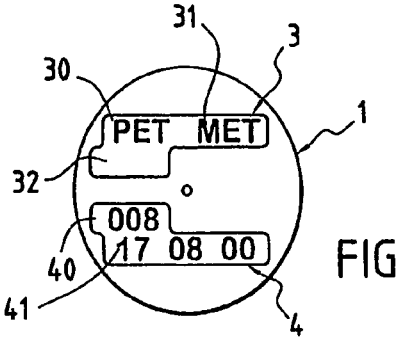
FIGS. 6A and 6B illustrate the setting and the display of a date corresponding to the start time, called "PET", of a phase of the space mission with relation to the start date of the space mission.

FIG. 6A illustrates a setting example for a "PET" (function entered and displayed in zone 30) assuming that the zero time t'0 (FIG. 1) with relation to the "MET" (FIG. 1: t0) is 8 days 17 hours 8 minutes 0 seconds. Zone 31 displays the letters of the "MET" function. Zone 32 does not display any data. "0 0 8" is entered in zone 40 and "17 08 00", in zone 41.

Alternatively, if "PET" is defined with relation to "GMT", the letters for this function are entered and displayed in zone 31. "−3", "5" and "18 01 12" are entered in zones 32, 40 and 41, respectively.

In this same case, also as an alternative, the letters "GMT" are entered and displayed in zone 31. "−", "065" and "18 01 12" are entered in zones 32, 40 and 41, respectively.

Figure 6B:
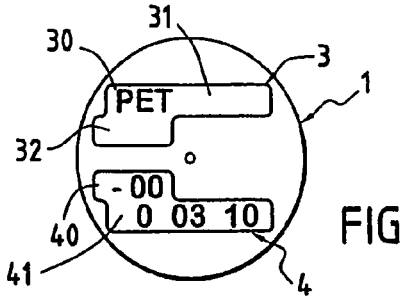

FIG. 6B illustrates an example of the display of the "PET" function (zone 30) at 3 mn and 10 s (zone 41: "0 03 10") from the zero time. Zone 40 displays "−0 0", the "−" sign ("negative" time) indicating that the zero time t'0 is in the future. Zones 31 and 32 do not display any data.

Alternatively, if "GMT" is not defined, zone 31 displays " - - - " and zones 40 and 41 display "000" and "0 00 00", respectively.

As for "MET", a "−" sign positioned under "PET" during the setting based on the "GMT" time indicates that the date of the zero time of the "PET" used for the setting is in the future. This is the default value. A "+" sign means that the start time of the "MET" is in the past. This operating procedure avoids, as specified previously, having to include the current year when entering the date of the zero time.

It should be noted that "PET" operates in a very similar manner to "MET" but that it applies to occasional operations, whereas "PET" is moreover dedicated to the mission as a whole.

As specified previously, the watch comprises advantageously five "Timers" (or more) in such a way as to be able to set and display an equal number of alarms which are independent from each other and refer to the different time scales: "$T_2$", "$T_2$", "GMT", "MET", etc.

Figure 7A:
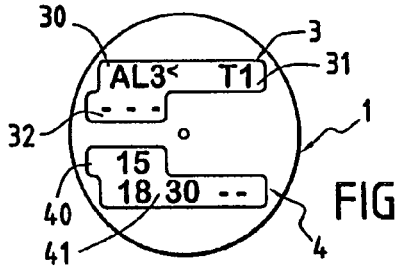
FIGS. 7A to 7C, illustrate the setting and the display of three alarms.
Figure 7B:
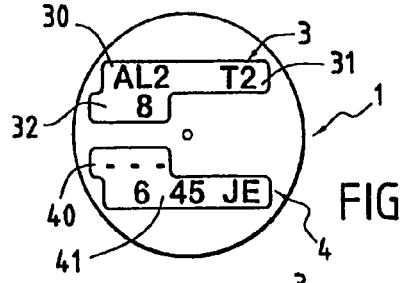
Figure 7C:
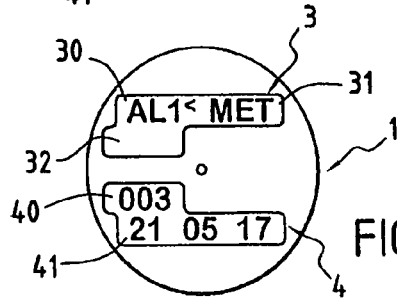

To fix ideas, it shall now be illustrated, with reference to FIGS. 7A to 7C, the setting and the display of three of these possible alarms, arbitrarily named "AL 1" to "AL 3", respectively.

The setting and the display of the first alarm, "AL 1", (indicated by zone 30) is illustrated by FIG. 7A. This alarm refers to the "MET" time scale (FIG. 1).

The "MET" scale is indicated in zone 31 and the alarm is set for 3 days (zone 40) 21 H 5 mn 17 s. The "AL 1" alarm is active (status referred to as "ON"): this status is symbolised by the "<" sign displayed in zone 30 to the right of the "AL 1" sign. For example, the setting is carried out for 3 days 21 hours 05 minutes 17 seconds. "0 0 3" and "21 05 17" are entered and displayed in zones 40 and 41, respectively. Zone 32 does not display any data.

As a first alternative for the setting, "079" and "2 10 00" are entered and displayed in zones 40 and 41, respectively.

As a second alternative for the setting, "19" and "2 10 00" are entered and displayed in zones 40 and 41, respectively.

Furthermore, the setting and the display of the second alarm, "AL 2", (indicated by zone 30) is illustrated by FIG. 7B.

This alarm refers to the "$T_2$" time scale (FIG. 1).

The letters of the "$T_2$" time scale are entered and displayed in zone 31, and the "AL 2" alarm is set to go off every Thursday ("TH" sign displayed by the last two digits of zone 41) in the month of August (figure "8": zone 32) at 6 H 45 mn (first section of zone 41: "6 45").

The alarm "AL 1" is disabled in the example provided in FIG. 7B (status called "OFF"): this status can be interpreted as such because the "<" sign is not displayed in zone 30. Zone 40 displays " - - - ".

Lastly, the setting and the display of the third alarm, "AL 3", (indicated by zone 30) is illustrated by FIG. 7C.

This alarm refers to the "$T_1$" time scale (FIG. 1). The letters of the "$T_1$" time scale are entered and displayed in zone 31, and the alarm "AL 3" is set for the 15th (zone 40) of each month at 18 H 30 (zone 41: 18 30 - -). The "AL 3" alarm is enabled (status called "ON"): this status is symbolised by the "<" sign displayed in zone 30 to the right of the "AL 3" sign. Zone 40 displays " - - - ".

When the alarms go off, the watch emits preferentially an audio signal attracting the operator's attention, for example, a predetermined sequence of audio "beeps".

To fix ideas, for the "AL 3" alarm, the repeated sequence of three "beeps" can be adopted: "beep.beep.beep - - - beep. beep.beep - - - beep. beep.beep etc.", until the alarm is switched off by the operator (the dashes represent a pause in the emission). The same can apply for the other alarms:

for example, a repeated sequence of two "beeps" for the "AL 2" alarm, etc. Preferentially, the watch 1 comprises five alarms.

As specified previously, the time and the minutes of time scales "$T_1$" or "$T_2$" can also be displayed permanently by the analogue section of the watch: hands 2 (FIG. 1).

In a practical manner, a number of other conventions can be adopted for the configuration of different settings and displays, notably in view of producing good ergonomics, conventions accessible to Skilled Professionals and not requiring detailed description.

With regards to the characteristics that are more specific to the invention, the following can nevertheless be clarified:

Setting "MET" or "PET" consists in setting the date of the zero time expressed in another time scale ("$T_1$", "GMT", . . . ). When three dashes (" - - - ") are displayed in the position of the reference time, this means that "MET" or "PET" are undefined.

The "MET", "PET" and "Timer" ("TMR") displays are associated to the "–" sign when they are counting-down time, i.e. when the date corresponding to the programmed "zero" time is located in the future.

When the "zero" time is crossed, "MET", "PET" and the "Timer" mark this time by emitting an audio signal, for example an alarm which characterises the function in question and carry on counting forward without stopping. For example, to fix ideas, the "MET" alarm only lasts 5 seconds whereas "PET" and "Timer" alarms last longer (typically between 30 and 60 seconds). The operator can stop the alarm without interrupting the counting of time which, in all three cases, continues to count forward without stopping. This continuous count is advantageous in that it informs the operator of the time elapsed since the "zero" time was crossed.

"GMT" must be set before "$T_1$" and "$T_2$" which are set according to the time zone differential since "GMT".

"$T_1$", "$T_2$", or "GMT" must be set before "MET", for which the zero time can be defined in one of these three time scales.

"GMT" or "MET" must be set before "PET", for which the zero time can only be defined in the time scale "GMT" or "MET".

in a preferred embodiment, when setting "MET" or "PET", the operator is given the option of selecting no reference time in order to notify that there is no "mission" or "phase" underway. "MET" or "PET", respectively, no longer need to be displayed.

A practical embodiment of the watch according to the invention will now be described as well as command means for setting it, i.e. the input and entry of data and the display of this data, with reference to FIG. 8.

Figure 8:
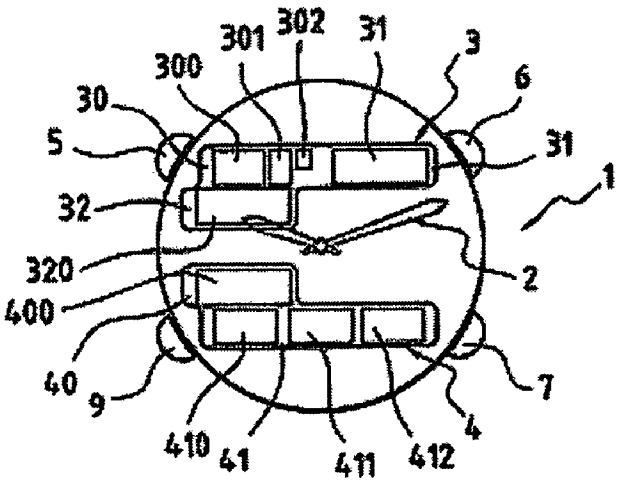
FIG. 8 illustrates in more detail the viewing components and push-button command components of the watch from FIG. 1.

In FIG. 8, all elements identical to those in FIGS. 1 to 7C bear the same references and will not be re-described unless so required.

In the preferred embodiment of the watch 1, four push-buttons, 5, 6, 7 and 9, suffice to command (settings and displays) the watch's times and functions. Push-buttons are favoured over dial buttons, since they do not require removal of the watch 1 from the user's wrist for adjustment. The control buttons, 5, 6, 7 and 9, are disposed advantageously, to begin with, symmetrically on each side of the watch 1, then in the upper (buttons 5 and 6) and lower (buttons 7 and 9) sections of its sides, in such a way as to prevent the presence of a button in the central zone which could create a hard pressure point on the back of the user's wrist when bending the hand.

The digital display zones, 30 to 41, are subdivided into what will be referred to as fields hereafter:

Zone 30: fields 300, 301 and 302;

Zone 3: unique field 31;

Zone 32: unique field 320;

Zone 40: unique field 410;

Zone 41: fields 410, 411 and 412;

In brief, the operating procedure for these control buttons is advantageously the following:

Time scales and functions are selected in order, by quick pressing action on button 7 or in reverse order by quick pressing action on button 5.

The setting mode for a time or a function is started, starting from the normal display of this time or of this function, by pressing action on button 5 for over 2 seconds. The setting fields are then selected cyclically by successive pressing action on button 6. The field subject to the setting operation is identified by the flashing of the current value. The first adjustable field (flashing) in the cycle is that of the first adjustable parameter of the time or of the current function. For example, for the "$T_1$" setting, it concerns field 310 but, for the "TMR", the first flashing field is the field 400 indicating the counting direction sign (positive or negative).

The time scale "$T_1$" or "$T_2$" that is required to be shown by the hands is selected by exerting long simultaneous pressing action on buttons 7 and 5 during the standard display of the required time scale. The cycle of the time scale's adjustable fields thereby selected ("$T_1$" or "$T_2$") enables the setting of hands independently from the digital display which, in practice, enables the display of a third time scale if so required.

The last field (flashing) of the full cycle of all adjustable fields is the one that indicates the time or the function currently being set; pressing once on button 5 then ends the setting mode. After having initiated the setting mode, if the only button handled during a full cycle of field change is button 6, pressing button 5 again will end the setting mode without any changes being applied to the time or to the function currently displayed.

Upon starting the "MET", "AL" or "PET" setting mode, the default reference time is the time scale which was used for the previous setting operation carried out on these functions.

During a setting operation, pressing button 7 or 5 for a long time accelerates the setting operating by making the characters scroll fast in the field that is flashing.

When an alarm is activated because "MET" or "PET" or the "TMR" has just crossed the zero time, pressing quickly on button 5 stops the alarm without any other action on the watch.

To fix ideas, the tables, "$T_1$" TABLE, "$T_2$" TABLE, "GMT" TABLE, "MET" TABLE, "AL" TABLE, "CHR" TABLE, "TMR" TABLE, and "PET" TABLE, at the end of the present description illustrate in a more detailed manner the settings of a watch 1 conform with the invention.

Generally, to improve the description's clarity, the reference numbers for push-buttons, 5, 6, 7 and 9, are positioned between "( )", reference numbers for fields are positioned between "[ ]". Furthermore, the "*" character means "single or repeated short pressing action(s)" and the "**" character means "long pressing action typically greater than 2 seconds".

Figure 9:
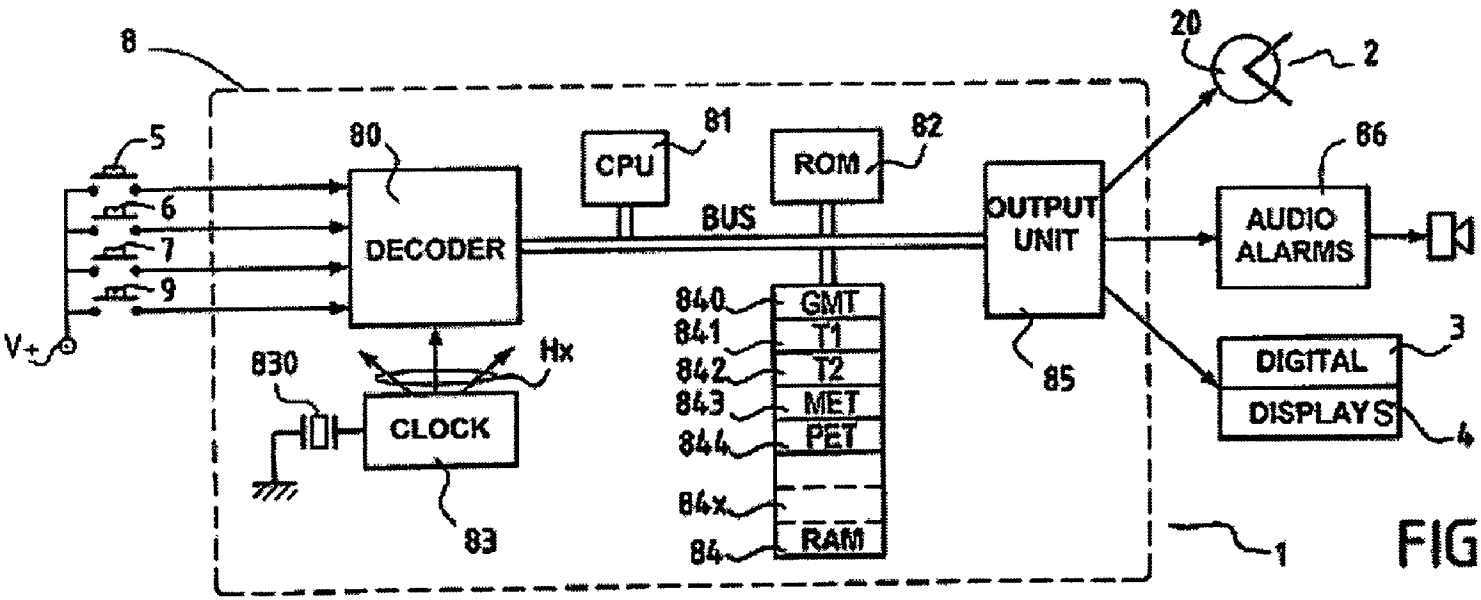
FIG. 9 is a block diagram illustrating schematically the main electronic circuits necessary for the correct operation of the watch according to the invention.

FIG. 9 illustrates in a schematic manner, in block diagram form, the electronic circuits 8 necessary for the operation of the watch 1 according to the invention.

The four control buttons, 5, 6, 7 and 9, act as input components for entering data into the watch 1.

Said buttons are linked, on one side, to a source of power, for example positive "V+", arbitrarily representing a logic "1" when the push-button is operated and on the other side to logic circuits 80, that will be referred to as "decoder".

This decoder comprises combinational logic circuits (based on standard logic circuits "AND", "OR", "EXCLUSIVE-OR", etc.) and sequential logic circuits, as well as pulse counters and count-down counters. It receives several clock signals generated by clock circuits and time base 83 under the general reference Hx.

In a per se conventional manner, the circuits generating clock signals Hx are piloted by a quartz 830. The clock signals Hx are distributed in an appropriate manner to the other circuit blocks 8, and act notably as a time base for the watch 1 displays: digital displays, 3 and 4, and 5, analogue display 2.

As specified previously, with reference to the description in FIG. 8, the decoder circuits 80 detect, either the unique clock pulses incurred by brief pressing on one of the control buttons, 5 to 7, a combination of these pulses, and/or a determined period of time, i.e. long pressing action on one or more of these buttons 5 to 7.

The circuits 8 are articulated, in a conventional manner around a bus 87 of two-way data transmissions.

The output of the decoder 80 is linked to this bus 87 and data input operations, during aforementioned settings, are sent to a central unit 81, comprising a microprocessor or a microcontroller, linked via this bus 87 to a read-only memory unit 82, of "ROM" (for "Read Only Memory") type or an alternative non-volatile memory of similar type. This memory unit 82 stores firmware or micro-instructions managing, in a per se known manner, the operation of circuits 8 under the command of the microprocessor 81.

The circuits 8 also comprise a random access memory unit 84, for example of the type called "RAM" (for "Random Access Memory") and/or a plurality of memory registers.

This memory 84 must comprise memory locations for storing settings data entered using control buttons 5 to 7, and notably five memory locations, 840 to 844, dedicated to "GMT", "$T_1$", "$T_2$", "MET" and "PET", as well as 84x locations for the different alarms. In reality, a higher quantity of memory locations are necessary. They are assigned, in a permanent or non-permanent manner, to values such as "period to be timed", etc. Furthermore, different values are calculated, under the command of the microprocessor 81 and firmware stored in the memory 82, using aforementioned data or combinations of this data, for example to generate and display "PET" using the "GMT" or "MET" time scale. These calculations generate intermediate values which also need to be stored in locations of the random access memory 84.

The bus 87 is also connected to an interface unit of output 85 distributing command signals to the two display units: analogue hands 2, more specifically to a driving motor 20 or an alternative similar component, and digital, 3 and 4. Preferentially the motor 20 is a step motor receiving forward clock pulses.

This interface unit of output 85 also generates electric command signals sent to an audio alarm signal generation unit 86.

By reading the above, it is easy to establish that the invention effectively achieves its set objectives.

It should however be made clear that the invention is not restricted to the sole examples of embodiments explicitly described, notably in relation with FIGS. 1 to 9.

For example, the audio alarms can be replaced or doubled with other types of alarm: visual, vibrating, etc.

Lastly, the numerical examples have only been provided to better fix ideas and do not comprise a restriction of any kind to the scope of the present invention. They derive from a technological choice which is easily accessible to Skilled Professionals.

The watch can, notably, comprise more than five alarms and more than two local time zones.

TABLE

| | "Display parameters" | | | |
|---|---|---|---|---|
| Mode | "$T_1$" or "$T_2$" | "GMT" or "MET" | Timer "TMR" | Chrono "CHR" |
| Normal | M.J.D.h.m.s | d.h.m.s or for "GMT" M.J.D.h.m.s | h.m.s | h.m.s.s/100 |
| Alarm | M.J.D.h.m | d.h.m.s or for "GMT" M.J.D.h.m.s | | |
| "PET" | | d.h.m.s | | |

"$T_1$" Table

Assuming that "$T_1$" is selected as the time scale for hands 2 (the setting of hands 2 is independent from values on the digital display 3-4 and is only used to readjust manually the hands 2 on the digital display of "$T_1$", if there is a difference between the two).

The default value of "$T_1$" at the initial settings operation is equal to "GMT".

(7)* or (5)* until [300]="$T_1$".

(5) [310**] flashes and indicates "GMT".

(7)* or (5)* is used to select flashing indication of "GMT" or "H-M" in the field [310].

If [310]="GMT", the time zone differential setting starts:

(6)* [320] flashes and indicates the current time zone differential value.

(7)* or (5)* until [320]=the required time zone differential. The fields [6] and [7] are then changed accordingly. The hour hand follows the adjustment of the time zone differential. (The minutes and seconds can only be corrected when setting the "GMT").

(6)* [300] flashes.

(5)* "$T_1$" returns to standard display, integrating the time zone differential change.

If [310]="H-M", the setting of hands starts without affecting the digital display:

(6)* "H" flashes in the field [310].

(7)* or (5)* until the hour hand indicates the required time. The hour hand automatically positions itself precisely between two hour graduations according to the current position of the minute hand.

(6)* "M" flashes in the field [310].

(7)* or (5)* until the minute hand indicates the required minutes. The minute hand automatically positions itself precisely between 2 graduations of 30 minutes according to the current value of seconds indicated in the field [412].

(6)* [300] flashes.

(5)* The watch 1 exits the setting mode for hands 2 which follow the selected time scale precisely ("$T_1$" in the chosen example).

"$T_2$" Table

"$T_2$" is set in the same manner as "$T_1$". If the hands 2 represent "$T_1$" and the operator wishes to set the hands during the "$T_2$" setting, before proceeding with the settings, "$T_2$" must be selected as the time scale for hands 2 by pressing simultaneously (7) and (5) for over 2 seconds.

The possible independent setting of hands 2 in hours and minutes can enable adjustment of the analogue time (the hands 2) to the time zones which are not different to "GMT" in full hours.

"GMT" TABLE

The default value of "GMT" at the initial setting is "Monday 1st January 0 h 00 m 00 s of the year 00" (In English).

(7)* or (5)* until [300]="GMT".

(5) the language selected when the previous settings were made (for example "F" for French, "E" for English or "S" for Spanish) flashes in [310**]

(7)* or (5)* until the required language appears in the field [310].

(6)* the 2 figures "YY" indicating the previously set year, flash in [310].

(7)* or (5)* until "YY"=the last two figures of the current year.

(6)* [320] flashes and indicates the current month value.

(7)* or (5)* until [320]=the required month. 24 values are proposed: the 12 possible digital values for the month and the 12 names (shortened to 3 letters) for months in the language selected in the initial step of the setting operation for the above "GMT".

(6)* [400] flashes and indicates the current value of the date in the month.

(7)* or (5)* until [400]=the required date.

(6)* [410] flashes and indicates the current time value.

(7)* or (5)* until [410]=the required time. The hour hand increments or decrements by the same quantity of hours as set.

(6)* [411] flashes and indicates the current minutes value.

(7)* or (5)* until [411]=the required minutes. The minute hand increments or decrements by the same quantity of minutes as set.

(6)* [412] flashes and indicates the current seconds value.

(7)* or (5)* until [412]=the required seconds. The minute hand follows the current adjustment of seconds.

(6)* [300] flashes.

(7)* alternates between the display "M.D.h.m.s." and "ddd.h.m.s."

(5)* "GMT" starts the time count starting from the time value set by the above operations. The time "$T_1$" (digital and analogue), "$T_2$" and "MET" are also corrected automatically accordingly.

It should be noted that the hour and the minute hand simply follow the number of pressing actions exerted on the buttons (7) and (5) for the hours and the minutes respectively and independently of digital values obtained on the face of the watch 1. Only the digital value of seconds is used effectively for the fine positioning of the minute hand between two minute graduations.

"MET" TABLE

When the MET is set for the first time, [310]=- - - by default and all ensuing fields are initialised to zero, meaning that there is no currently defined "MET".

(7)* or (5)* until [300]="MET".

(5) — [310**] flashes and indicates the time scale used for the previous setting operation of "MET".

(7)* or (5)* until [310]=the required time scale or '- - - ' if use of "MET" is complete.

The setting steps differ depending on the scale selected, as follows:

If "GMT" is selected as time reference for setting "MET": (by default at the initial setting, the zero time is "001 day 0 h 00 m 00 s" which corresponds to the changeover to a new year, since day 0 does not exist on the calendar)

(6)* [400] flashes and indicates the day in the year (between 001 and 366) used for the previous setting operation.

(7)* or (5)* until [400]=the day of the year required for the zero time.

(6)* [410] flashes and indicates the time for the zero time used for the previous setting operation.

(7)* or (5)* until [410]=the required time for zero time.

(6)* [411] flashes and indicates the minutes for the zero time used for the previous setting operation.

(7)* or (5)* until [411]=the required minutes for the zero time.

(6)* [412] flashes and indicates the seconds for the zero time used for the previous setting operation.

(7)* or (5)* until [412]=the required seconds for the zero time.

(6)* [300] flashes.

(5)* MET counts and displays remaining time until, or the time elapsed since, the new value of the zero time.

If the operator prefers to set "MET" according to a date expressed in "Month-Day" in the "GMT" time scale, this display mode must first be selected for "GMT" according to the aforementioned "GMT" setting instructions. "MET" is set according to "GMT" in exactly the same manner as when setting "MET" according to "$T_1$" or "$T_2$" as described below.

If "$T_1$" or "$T_2$" is selected as time reference for the "MET" setting: (by default at the initial setting, the zero time is "1st January 0 h 00 m 00 s")

(6)* [320] flashes and indicates the month used for the previous setting operation.

(7)* or (5)* until [320]=the required month for zero time. The month values proposed are of the same type—digital or textual—as the display mode for months in the time scale selected as reference.

(6)* [400] flashes and indicates the value of the date in the month used for the previous setting operation.

(7)* or (5)* until [400]=the required date for zero time.

(6)* [410] flashes and indicates the hour for the zero time used for the previous setting operation.

(7)* or (5)* until [410]=the required time for zero time.

(6)* [411] flashes and indicates the minutes for the zero time used for the previous setting operation.

(7)* or (5)* until [411]=the required minutes for the zero time.

(6)* [412] flashes and indicates the seconds for the zero time used for the previous setting operation.

(7)* or (5)* until [412]=the required seconds for the zero time.

(6)* [300] flashes.

(5)* "MET" counts and displays the time remaining until, or the time elapsed since, the new zero time value.

If '- - - ' is selected in the field [310] at the start of the setting operation, all ensuing fields indicate zero:

(6)* [300] flashes.

(5)* ends the setting operation leaving "MET" undefined.

"AL" Table

The default value for the five Alarms at the initial setting is in the "GMT" scale on "Monday 1st January 0 h 00 m 00 s" and the alarm is disabled.

(7)* or (5)* until [300]="AL", [301] indicates the alarm number called up last which, by default at the initial setting, is '1'.

(6)* until [301]=the required alarm number for reading or in view of carrying out a setting operation.

(5) [300] and [302] flash and [302**] indicate by default the sign "<" meaning that the alarm is enabled.

(7)* or (5)* enable de-selection or re-selection of the alarm. The selection made thereof is indicated by the flashing presence or the total absence of the "<" sign.

(5)** (optional) ends the setting mode when the only modification has been the selection or de-selection of the alarm.

(6)* [310] flashes and indicates the time scale used for the previous setting operation.

(7)* or (5)* until [310]=the required time scale.

The sequence (6)* followed by (7)* or (5)* is repeated until all the fields are set with the required value. This setting is carried out as follows: during the setting of the alarm, if one of the parameters "M", "J" or "D" (case "$T_1$" or "$T_2$") or "d" (case "GMT" or "MET") is left "empty", the alarm is recurrent for each of the parameter's values, at the specified hour and minutes.

(6)* until [300] and [301] flash.

(5)* ends the setting mode.

"CHR" Table

Upon the initial setting operation of "CHR", by default all the adjustable fields [310], [410], [411] and [412] are initialised to the zero value.

(7)* or (5)* until [300]="CHR". The current or stopped time of the previous operation carried out on the Chronograph "CHR" is displayed.

(5) [310], [410], [411] and [412**] are reset to zero. This operation is unnecessary if the Chronograph "CHR" has already been reset to zero or if the operator wishes to start the Chronograph starting from the time displayed at the previous stop.

Standard use of the Chronograph "CHR":

(6)* starts the Chronograph "CHR".

(9)* (optional) stops and displays the intermediary time. CHR flashes to indicate that the time displayed is not the current time of the Chronograph "CHR".

(9)* (optional operation) cancels the intermediary time and returns to the display of the current time of the Chronograph "CHR" which may or may not already be stopped by (6)*.

(6)* stops the current time.

(7)* or (5)* at any point in time can be used to select another time or function and to exit the "CHR" function's display without altering its current operation.

"TMR" Table

Upon the initial setting operation of "TMR", by default all the adjustable fields [410], [411] and [412] are initialised to the zero value.

(7)* or (5)* until [300]="TMR". The current or stopped time of the previous operation carried out on the "TMR" is displayed.

(5) If the "TMR" has already been used since the previous setting operation, all the adjustable fields [400], [410], [411] and [412**] are reinitialised to the previous setting value. The "TMR" can be used immediately. If the "TMR" has not been used yet since the previous setting operation, this operation immediately calls upon the setting mode described in the next step.

(5) [400**] flashes and indicates by default the minus sign '–'. The "TMR" goes into setting mode.

(7)* or (5)* changes the sign in the field [400] if necessary. Also, [410], [411] and [412] are reinitialised to zero. If [400] indicates the '+' sign, the time counts forwards starting from the value indicated when the "TMR" function is started.

(6)* [410] flashes and indicates by default the value of the time at the previous setting operation if [400] has not been changed. Otherwise the default value is zero.

(7)* or (5)* until [410]=the required time.

(6)* [411] flashes and indicates by default the value of minutes at the previous setting operation if [400] and [410] have not been changed. Otherwise the default value is zero.

(7)* or (5)* until [411]=the required minutes.

(6)* [412] flashes and indicates by default the value of seconds at the previous setting operation if [400], [410] et [411] have not been changed.

Otherwise the default value is zero.

(7)* or (5)* until [412]=the required seconds.

(6)* [300] flashes.

(5)* The "TMR" setting is complete. It is ready to be used as follows:

(6)* alternately starts and stops the "TMR".

(7)* or (5)* at any point in time can be used to select another time or function and to exit the "TMR" function's display without altering its current operation.

"PET" Table

Upon the initial setting operation of "PET", by default [310]= - - - and all ensuing fields are initialised to zero, meaning that there is no current PET is defined.

(7)* or (5)* until [300]="PET".

(5) [310**] flashes and indicates the time scale used for the previous setting operation of PET.

(7)* or (5)* until [310]="MET", "GMT" or " - - - " if the operator wishes to stop using "PET".

If "MET" or "GMT" are selected as the time scale for defining "PET": (by default at the initial setting operation, the zero time is "000 jour 0 h 00 m 00 s" for "MET" and "001 jour 0 h 00 m 00 s" for "GMT")

(6)* [400] flashes and indicates the day of "MET" or "GMT" used for the previous setting operation (between −99 and 999 for "MET", or between 001 and 366 for "GMT").

(7)* or (5)* until [400]=the day of "MET" or "GMT" required for the zero time.

(6)* [410] flashes and indicates the hour for the zero time used for the previous setting operation.

(7)* or (5)* until [410]=the required time for zero time.

(6)* [411] flashes and indicates the minutes for the zero time used for the previous setting operation.

(7)* or (5)* until [411]=the required minutes for the zero time.

(6)* [412] flashes and indicates the seconds for the zero time used for the previous setting operation.

(7)* or (5)* until [412]=the required seconds for the zero time.

(6)* [300] flashes.

(5)* "PET" counts and displays the time remaining until, or the time elapsed since, the new value of the zero time expressed in the time scale "MET" or "GMT".

If ' - - - ' is selected in the field [310] at the start of the setting operation, all ensuing fields indicate zero:

(6)* [300] flashes.

(5)* ends the setting operation leaving "PET" undefined.

The invention claimed is:

1. An electronic watch providing navigational aid for a mission, said navigation being associated to a start time of a first predetermined event, comprising:

an input device for entering date or duration data to provide entered data;

a storage device for storing said entered data entered;

a processor for calculating and generating clock signals; and a digital display for displaying said entered data or data generated using said entered data by said processor; and wherein said mission is a space mission and comprises a plurality of phases;

wherein said first predetermined event corresponds to a start of said space mission;

wherein said input device and said storage device are operable to enter and store a first start date linked to the Universal Time as determined by the Greenwich meridian to enable said processor to generate a first time scale having a start date corresponding to said first start date, said first time scale is Greenwich Meridian Time (GMT);

wherein said input device and said storage device, at any point in time, are operable to enter and store a second start date corresponding to said first predetermined event to enable said processor to generate a second time scale, said second time scale being different from said first time scale, is mission elapsed time (MET);

wherein said digital display is operable to display a negative time value when said first start date is in the future and a positive time value when said first start date has elapsed, thereby displaying said positive and negative time values relating to said predetermined event compared to a plurality of different time scales;

wherein said input device and said storage device are operable to enter and store a time zone differential data to enable said processor to generate a third start date corresponding to a third time scale, said third time scale being different from said first and second time scales, and is one of the following: phased elapsed time (PET), local time zone or one of a plurality of time zones;

wherein said input device and said storage device, at any point in time, are operable to enter and store said time zone differential data to enable said processor to generate at least a fourth start date corresponding to a fourth time scale, said fourth time scale being different from said first, second and third time scales, and is one of the following: PET, local time zone or one of a plurality of time zones with a start date corresponding to said fourth start date;

wherein said input device and said storage device are operable to enter and store a fifth start date corresponding to a predetermined second event or corresponding to the start of one of said phases;

wherein said processor is operable to generate a fifth time scale as a function of one of said GMT or MET by selective operation of said input device; and wherein said digital display is operable to display a negative time value when said fifth start date is in the future and a positive time value when said fifth start date has elapsed.

2. The electronic watch of claim 1, further comprising a plurality of alarms; wherein said input device and said storage device are operable for entering and storing alarm dates which selectively activates one of said plurality of alarms in accordance with one of said time scales.

3. The electronic watch of claim 2, wherein said plurality of alarms is operable to generate a quantity of alarms equal to five.

4. The electronic watch of claim 3, wherein said plurality of alarms is operable to deliver audio signals; wherein said audio signals comprise sequences of audio "beeps"; wherein each of said sequences is different from each other and is selectively associated to one of said plurality of alarms.

5. The electronic watch of claim 2, wherein said storage device comprises a plurality of random access memory for recording at least data characterizing said start dates and said alarm dates.

6. The electronic watch of claim 1, wherein said input device comprises four push-buttons for entering data by a brief pressing action on one of said push-buttons, a brief pressing action on predetermined combinations of said four push-buttons or a long pressing action of predetermined period on at least one of said push-buttons.

7. The electronic watch of claim 1, further comprising an analog display with hands for displaying one of said third or fourth time scales.

* * * * *